US010655797B2

(12) United States Patent
Beijer

(10) Patent No.: US 10,655,797 B2
(45) Date of Patent: May 19, 2020

(54) ELONGATED LIGHTING DEVICE BASED ON SOLID STATE LIGHTING TECHNOLOGY

(71) Applicant: SIGNIFY HOLDING B.V., Eindhoven (NL)

(72) Inventor: Johannes Gerrit Jan Beijer, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 455 days.

(21) Appl. No.: 15/213,342

(22) Filed: Jul. 18, 2016

(65) Prior Publication Data

US 2017/0045183 A1 Feb. 16, 2017

(30) Foreign Application Priority Data

Aug. 13, 2015 (EP) ..... 15180874

(51) Int. Cl.

| | |
|---|---|
| ***F21K 9/275*** | (2016.01) |
| ***F21V 15/01*** | (2006.01) |
| ***F21K 9/27*** | (2016.01) |
| ***F21K 9/66*** | (2016.01) |
| ***F21K 9/272*** | (2016.01) |
| ***F21K 9/278*** | (2016.01) |
| *F21V 3/06* | (2018.01) |
| *F21Y 101/00* | (2016.01) |

(Continued)

(52) U.S. Cl.

CPC ..... *F21K 9/275* (2016.08); *F21K 9/27* (2016.08); *F21K 9/272* (2016.08); *F21K 9/278* (2016.08); *F21K 9/66* (2016.08); *F21V 15/01* (2013.01); *F21V 3/062* (2018.02); *F21V 7/005* (2013.01); *F21V 15/015* (2013.01); *F21V 17/00* (2013.01); *F21Y 2101/00* (2013.01); *F21Y 2103/10* (2016.08); *F21Y 2115/10* (2016.08)

(58) Field of Classification Search

USPC ..... 362/217.12

See application file for complete search history.

(56) References Cited

U.S. PATENT DOCUMENTS 5,093,767 A * 3/1992 Burn ..... F21S 8/035 362/125

6,536,915 B1 3/2003 Chang (Continued)

FOREIGN PATENT DOCUMENTS

CN 201916722 U 8/2011

CN 202719403 U 2/2013

(Continued)

*Primary Examiner* — Michael G Lee

*Assistant Examiner* — David Tardif

(74) *Attorney, Agent, or Firm* — Akarsh P. Belagodu

(57) ABSTRACT

An elongated lighting device (1) having a first and a second suspension point (8, 8') for suspending the lighting device (1), comprising: a plastic housing (2) extending from the first suspension point (8) to the second suspension point (8'); a light source carrier (4) having one or more solid state light sources (6) mounted on a surface thereof, the carrier (4) being arranged along the housing (2) so that the one or more light sources (6) emit light into the housing (2). A wire (10) is arranged inside the housing (2) between the first and second suspension points (8, 8') so as to prevent the lighting device (1) from bending.

9 Claims, 4 Drawing Sheets

(51) Int. Cl.

| | |
|---|---|
| *F21V 15/015* | (2006.01) |
| *F21Y 115/10* | (2016.01) |
| *F21Y 103/10* | (2016.01) |
| *F21V 17/00* | (2006.01) |
| *F21V 7/00* | (2006.01) |

(56) References Cited

U.S. PATENT DOCUMENTS

| | | | | |
|---|---|---|---|---|
| 9,568,176 | B2 * | 2/2017 | Ye | F21K 9/90 |
| 2014/0009923 | A1 | 1/2014 | Wu | |
| 2014/0240973 | A1 | 8/2014 | Ye et al. | |

FOREIGN PATENT DOCUMENTS

| | | | |
|---|---|---|---|
| CN | 203068415 | U | 7/2013 |
| CN | 203517436 | U | 4/2014 |
| DE | 20107247 | U1 | 9/2001 |
| DE | 202004003377 | U1 | 6/2004 |
| EP | 69665 | A1 | 1/1983 |
| JP | 5227147 | B2 | 7/2013 |
| WO | 2014026976 | A1 | 2/2014 |
| WO | 2014050336 | A2 | 4/2014 |

* cited by examiner

ELONGATED LIGHTING DEVICE BASED ON SOLID STATE LIGHTING TECHNOLOGY

TECHNICAL FIELD

The present invention relates to an elongated lighting device based on solid state lighting (SSL) technology.

BACKGROUND

There is currently a strong trend to replace conventional lighting devices with lighting devices based on SSL technology for reasons of energy efficiency and operational lifetime. An example of a lighting device of the latter type is the light emitting diode (LED) tube lamp disclosed in US 2014/0009923 A1. Elongated lighting devices such as lighting tubes usually have a row of LEDs on a circuit board supported by a metal frame or similar inside an elongated housing. The housing can be made of glass, like in US 2014/0009923 A1, but for some applications it should be plastic.

A common problem with plastic housings is that they may over time become slightly curved due to creep caused by the gravitational force. Further efforts aimed at finding ways that help to prevent lighting devices with plastic housings from losing their shape over time are warranted.

One solution to this problem is to increase the dimensions of the metal frame, so as to provide additional structural strength to the lighting device. However, such an approach will make the lighting device heavier, and also reduce the amount of available space inside the tube.

SUMMARY

Therefore, it is an objective of the present invention to provide an improved or alternative elongated lighting device which is based on SSL technology and which has a plastic housing. Of particular interest is the ability of the lighting device to retain its shape over time.

According to a first aspect, there is provided an elongated lighting device which has a first and a second suspension point for suspending the lighting device and which comprises a housing extending from the first suspension point to the second suspension point; and a light source carrier having one or more solid state light sources mounted on a surface thereof, the carrier being arranged along the housing so that the one or more light sources emit light into the housing. A wire is arranged inside the housing between the first and second suspension points so as to prevent the lighting device from bending.

A "suspension point" is where the lighting device has some kind of means for suspending the lighting. The means for suspending the lighting device may be adapted to electrically connect the lighting device.

In particular, a housing made from plastics is susceptible for bending under gravitational forces.

By the housing being "plastic" is meant that it is made of a material that will deform when exposed to the force of gravity for a period of time that is shorter than the normal operational lifetime of the lighting device. The housing may for example be made of a material included in the wide range of polymer materials that are commonly referred to as "plastics".

The term "wire" is here meant to mean an elongated element such as a wire, cable, filament, thin film or similar.

The wire is not limited to be made of a particular material or to have a particular transverse cross section.

By the wire being arranged "between" the first and second suspension points is meant that one end of the wire is attached close to the first suspension point and the other end is attached close to the second suspension point. The wire thus extends along the entire length of the lighting device or substantially along the entire length of the lighting device.

The invention is based on the realization that the long term deflection of a lighting device without a wire due to creep in the housing depends mainly on the stiffness of the carrier. This is no longer the case for the lighting device according to the first aspect because the wire provides additional stiffness. The wire thus makes the lighting device stiffer and thereby helps reduce the long term deflection of the lighting device due to creep in the housing.

Further, it should be noted that the wire makes it possible to reduce the size of the carrier and still achieve a high stiffness lighting device. A small carrier has several advantages. Firstly, it is difficult to design lighting devices so that none of the light emitted by the light sources first strikes the carrier instead of falling directly onto the housing. Making the carrier smaller may reduce this problem and, consequently, improve the optical efficiency of the lighting device. Secondly, a small support may also make it possible to position the light sources relatively far away from the housing, something which may result in the light from the light sources being more homogenous when striking the housing. Finally, a small support is made with less material so its weight and its cost of production may be reduced.

It should also be noted that the wire and the carrier can be connected in a way that allows for easy disassembling and reassembling of the lighting device, something which facilitates repair and maintenance and which therefore is advantageous from a cost as well as an environmental perspective.

According to one embodiment, the housing has a longitudinal slit extending along an entire length of the housing, and the carrier is arranged in the slit.

According to one embodiment, the wire is pre-tensioned. The pre-tension avoids any sagging of the wire and ensures that the wire is stretched immediately when the lighting device sags. The pre-tension may for example be applied to the wire by pulling or twisting the wire before attaching it.

According to one embodiment, the carrier has a first end portion and a second end portion, and the wire is attached to the first and second end portions and separated from the carrier by two distance elements arranged between the first and second end portions. With this design, the wire may apply a rotational torque to the ends of the carrier, thus preventing any bending of the carrier. As a consequence, also the plastic tube is prevented from bending or sagging. An alternative way to achieve a similar effect is to attach the wire at points separated a distance from the carrier surface, and to ensure that these points are rotationally fixed in relation to the carrier. For example, suitable brackets may be fixedly mounted to the carrier, allowing attachment of the wire at a distance from the carrier surface.

According to one embodiment, the wire is attached to a first end piece and to a second end piece, and wherein the first end piece and the second end piece are attached to the housing, and support the wire at a distance from the carrier. The wire will thus interact with the housing, to prevent bending of the housing.

According to one embodiment, the first and second end pieces are end caps sealing ends of the housing. In this case, the wire may serve to hold the end caps against the ends of the housing. If the wire is attached to the end caps so that the ends of the wire are situated outside the housing, the lighting tube becomes particularly simple to disassemble by first cutting the wire and then removing the end caps.

According to one embodiment, the wire includes a fist leg arranged inside said housing, and a second leg arranged outside said housing, said first and second legs forming a closed loop around the carrier. The part of the wire that is outside the housing can advantageously be hooked up or otherwise connected to a luminaire or other fixed structure, so as to serve as a fall safety in case the lighting device is detached from its suspension.

According to one embodiment, the housing is straight.

It is noted that the invention relates to all possible combinations of features recited in the claims.

BRIEF DESCRIPTION OF THE DRAWINGS

The present invention will now be described in more detail with reference to the appended drawings in which.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
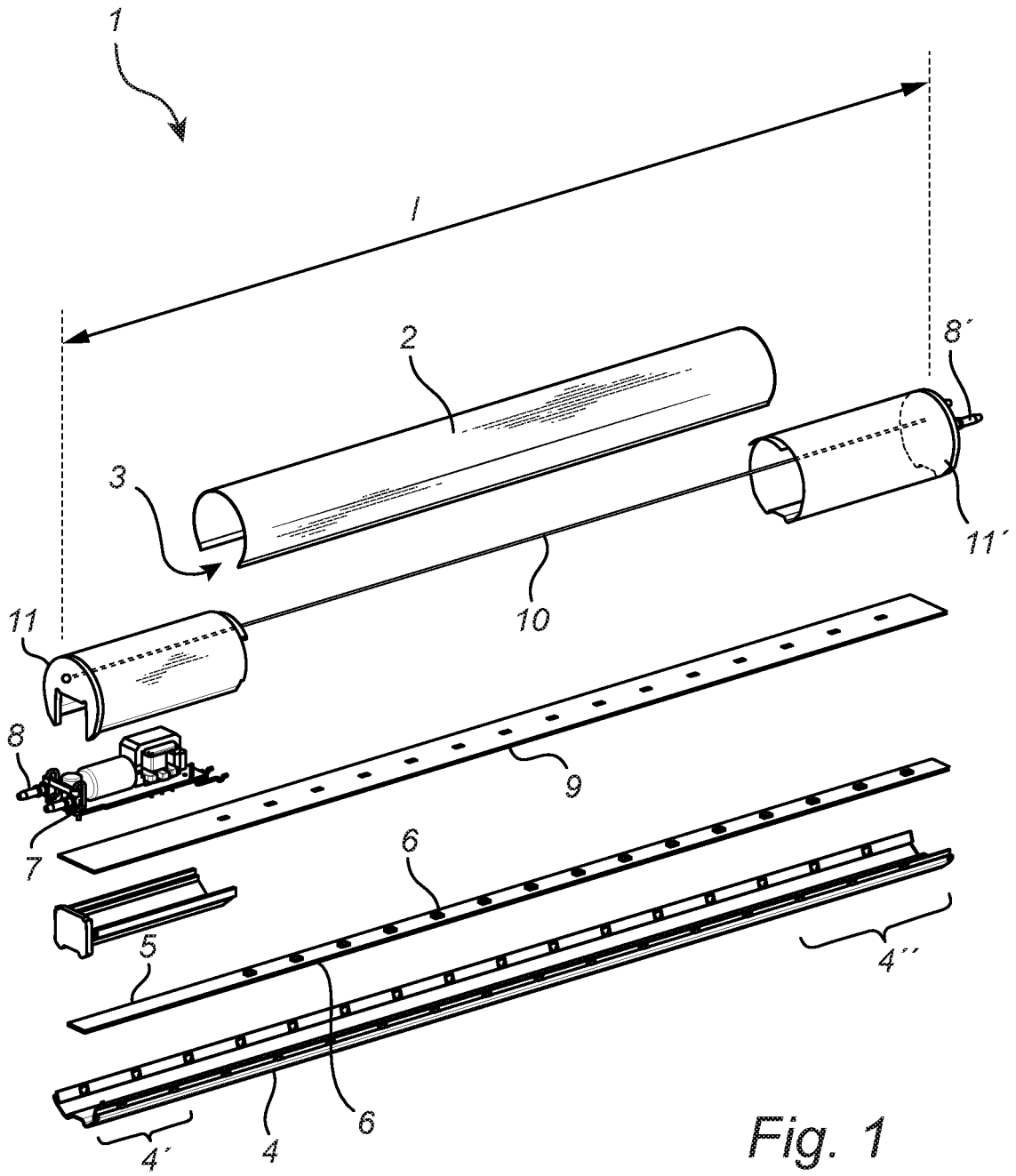
FIG. 1 shows a schematic exploded view of an example of a lighting tube.
Figure 2:
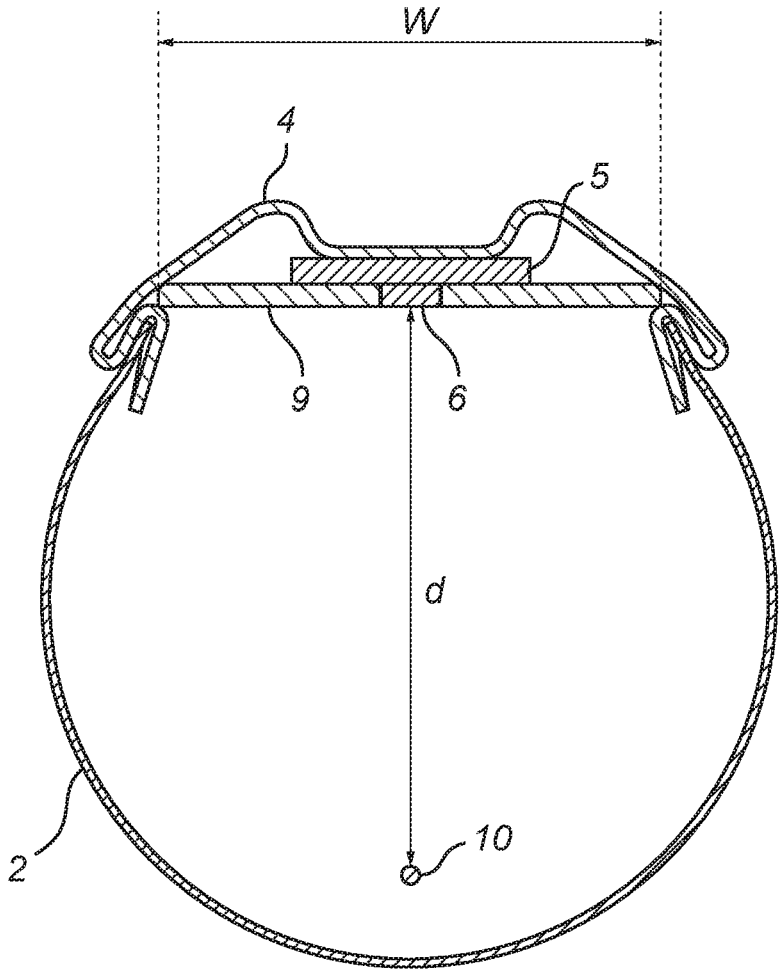
FIG. 2 shows a schematic cross sectional transverse view of the lighting tube in FIG. 1.
Figure 3:
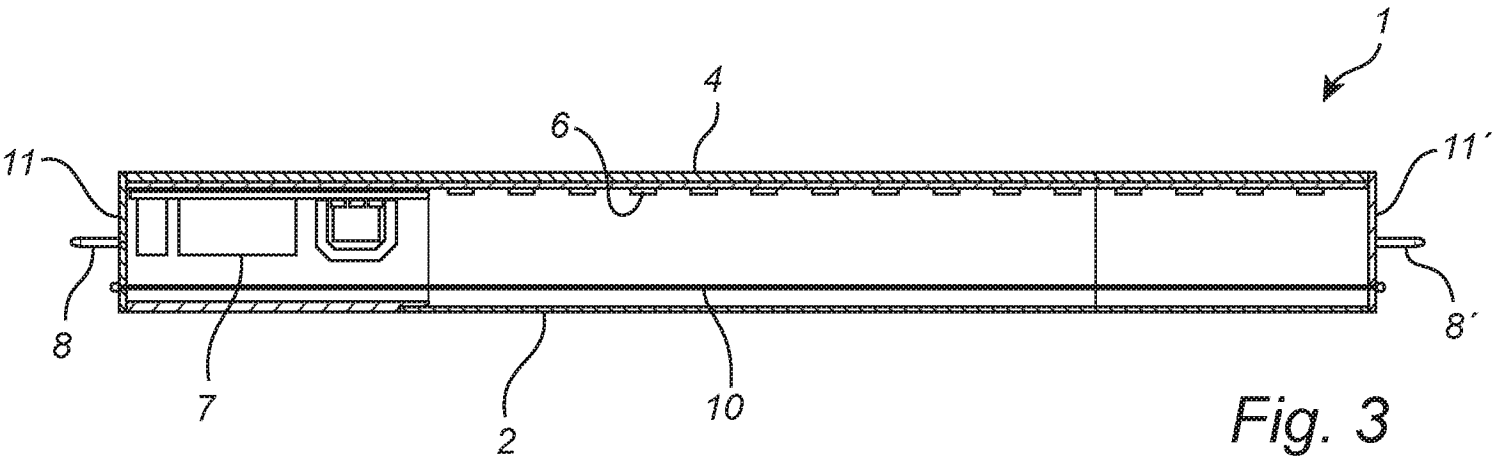
FIG. 3 shows a schematic cross sectional side view of the lighting tube in FIG. 1.

FIGS. 1, 2 and 3 show an elongated lighting device 1 in the form of a lighting tube which has a light transmissive plastic housing 2. The entire housing 2 is light transmissive in this example, but, in other examples, it may be that only a portion of the housing 2 is light transmissive. The housing 2 forms a straight tube having a longitudinal slit 3 that extends along the entire length of the housing 2. The transverse cross section of the housing 2 has an "open" shape, similar to a "C". The housing 2 is usually made of a polymer material such as polycarbonate. The length 1 of the housing 2 and the width of the slit 3 depend on the application. A light source carrier 4 (henceforth referred to as the "carrier" for brevity) is arranged along the housing 2 in the slit 3. The carrier 4 may be slidable into the slit 3 and/or clickable to the housing 2. The carrier 4 is usually made of a metal, such as steel or aluminum, and may for example be glued, clamped or screwed to the housing 2. The carrier 4 has a first end portion 4' and a second end portion 4" which is opposite the first end portion 4'.

It should be noted that the housing 2 may not have a slit 3 in other embodiments. The transverse cross section of the housing 2 then has a "closed" shape, typically the shape of a full circle but polygonal or elliptical shapes are also possible. The carrier 3 is in such embodiments positioned completely inside the housing 2.

A circuit board 5, such as a printed circuit board, is attached to a surface of the carrier 4 that faces the inside of the housing 2. In the illustrated example, the circuit board 5 is attached to an indentation which is directed towards the inside of the housing 2 and which extends along the central axis of the carrier 4. The circuit board 5 may be fixed to the carrier 4 by for example glue, screws or a clicking mechanism. The circuit board 5 electrically connects several solid state light sources 6 (henceforth referred to as the "light sources" for brevity) to a driver 7 configured to power the light sources 6. The driver 7 is arranged by the first end portion 4' of the carrier 4. Two pin-like connectors 8 for electrically connecting the driver 7 protrude to the outside of the housing 2. The connectors 8 also form a first suspension point of the lighting device 2. A second suspension point 8' is arranged by the opposite end of the lighting device 1 so that the housing 2 extends from the first suspension point 8 to the second suspension point 8'. The second suspension point 8' may for example be formed by a pin protruding to the outside of the housing 2.

The light sources 6 are in this example mounted in a straight row on the circuit board 5 so as to emit light into the housing 2. The light sources 6 may for example be semiconductor LEDs, organic LEDs, polymer LEDs, or laser diodes. All of the light sources 6 may be configured to emit light of the same color, for example white light, or different light sources 6 may be configured to emit light of different colors. A plate 9 is arranged on the circuit board 5. Other examples of the lighting device 1 may or may not be provided with a plate 9. The plate 9 covers the circuit board 5 and extends across approximately across the entire slit 3. The light sources 6 are positioned in holes formed in the plate 9. The surface of the plate 9 that faces the housing 2 is reflective so that light from the light sources 6 striking the surface is reflected back towards the housing 2. The reflective surface may be specular reflective or diffuse reflective. The plate 9 can for example be made of a white highly reflective polymer material.

A wire 10 extends inside the housing 2 between the first and second suspension points 8, 8'. The wire 10 is typically made of the same material as the carrier 4 or a different material that has the same or substantially the same coefficient of thermal expansion as the carrier 4. The transverse cross section of the wire 10 is in this example circular and has a diameter of approximately 0.5 mm. The wire 10 may have a smaller or larger diameter in other examples, and wires having cross sections with other shapes, such as rectangular, are conceivable. The shadow on the housing 2 of a wire 10 with a rectangular cross section may be quite small so that the wire 10 is particularly difficult to see from the outside. The wire 10 is supported by two end caps 11, 11' at a vertical distance d from the carrier 4 without being in direct contact with the housing 2. The end caps 11, 11' cover a respective end of the housing 2 and are a first and a second end piece of the lighting device 1. The wire 10 passes through holes in the end caps 11, 11' and is attached to the end caps 11, 11' on the outside of the housing 2.

In one embodiment, the wire 10 serves to attach the end caps 11, 11' to the housing 2. In other words, the end caps 11, 11' may be removed by simply cutting the wire 10. Alternatively, the end caps 11, 11' are separately attached to the carrier 4 and the housing 2. In any event, the wire 10 and the carrier 4, may be regarded as one mechanical unit. The bending stiffness of this unit may in some embodiments be approximately 18 $N \cdot mm^2$, and this may represent an increase in bending stiffness by approximately a factor of three relative to the case of an elongated lighting device without a wire.

The wire 10 may or may not be pre-tensioned. If the wire 10 is pre-tensioned then this may result in the carrier 4 having a slight curvature. As an example, the pre-tension may be approximately 2 N, and the midspan deflection of the carrier 4 may be approximately 0.5 mm upwards relative to the horizontal.

Figure 4:
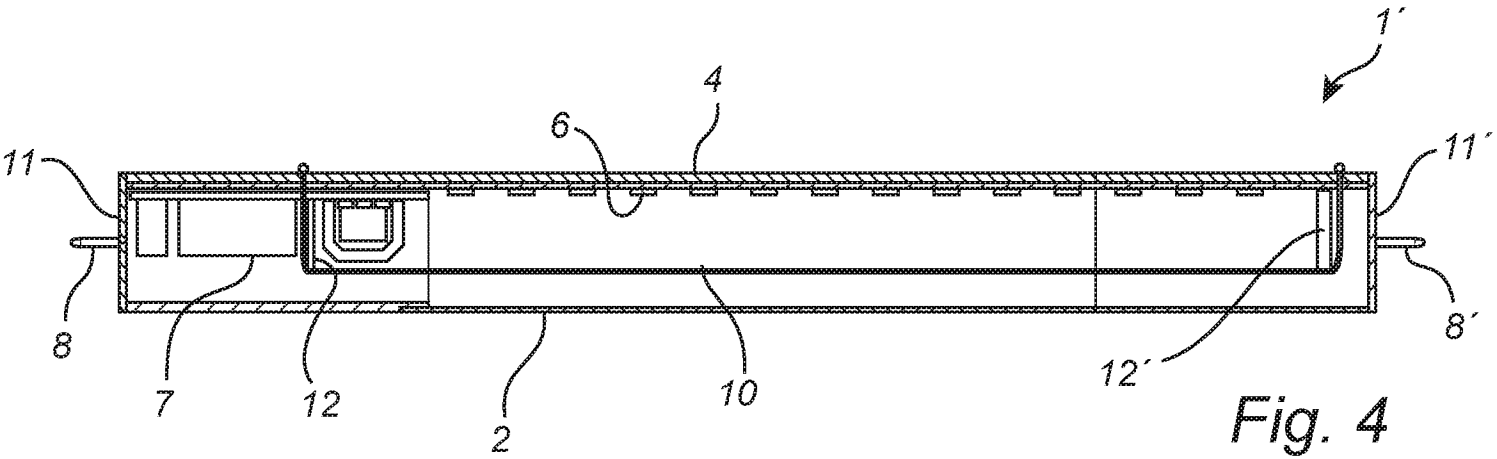
FIGS. 4 and 5 show schematic cross sectional side views of further examples of lighting tubes.

FIG. 4 shows a lighting tube 1' which is similar to the one in FIGS. 1 to 3 except that the wire 10 is directly attached to the first and second end portions 4', 4" of the carrier 4. The wire 10 is attached to the carrier 4 on the outside of the housing 2 and passes to the inside of the housing 2 through holes in the first and second end portions 4', 4". Two distance elements 12, 12' arranged by the first and second end portions 4', 4" supports the wire 10 so that the wire 10 is vertically separated from the carrier 4 between the distance elements 12, 12'. As can be understood, any bending force applied to the carrier 4 will be absorbed by the wire 10, preventing bending of the carrier 4 and the tube.

Figure 5:
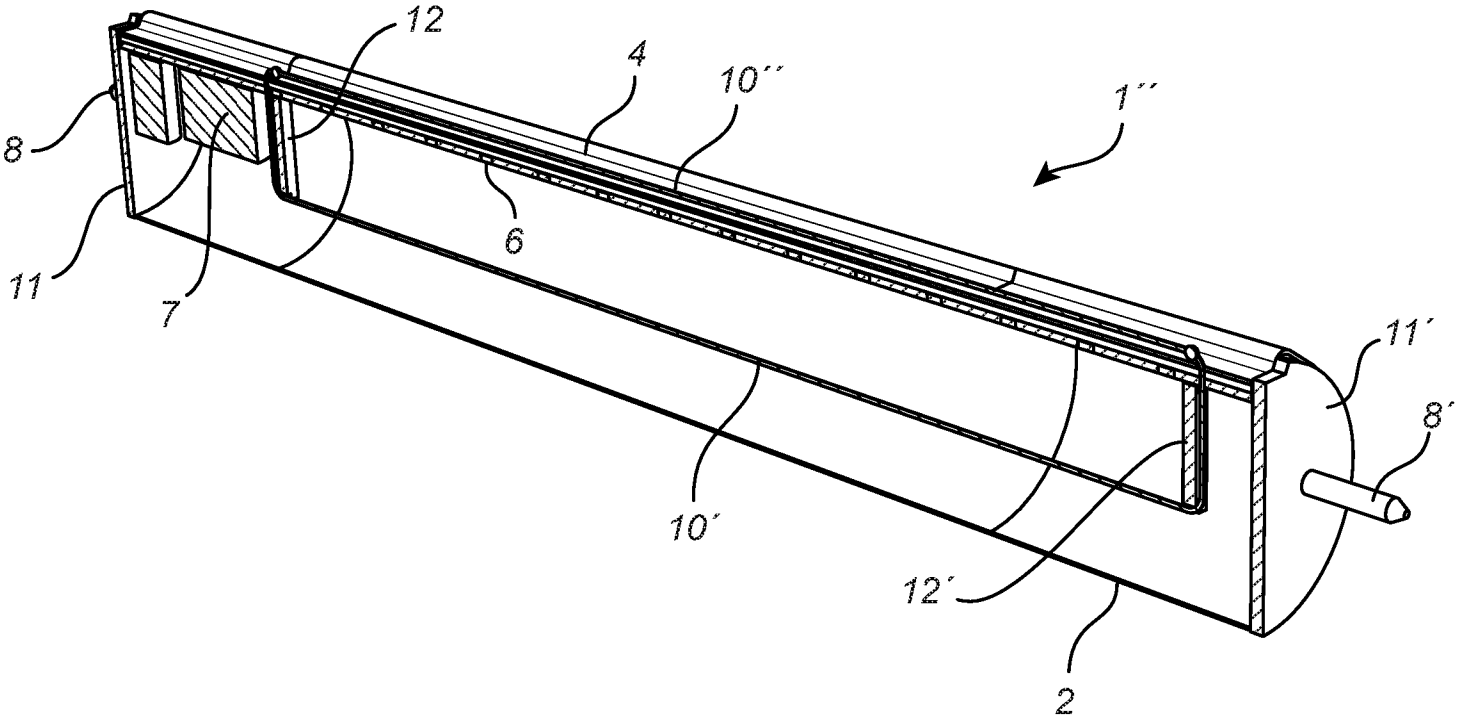

FIG. 5 shows a lighting tube 1" that is similar to the one in FIG. 4. This lighting tube 1", however, has a wire 10 that forms a closed loop around the carrier 4. The wire 10 has a first leg 10' arranged inside the housing 2 and a second leg 10" arranged outside the housing 2. The ends of the wire 10 are attached to each other on the outside of the housing 2. The wire 10 is fixed so as to be prevented from sliding. The second leg 10" of the wire 10 may be hooked up to a luminaire, serving as a safety means in the event that the lighting tube 1" is detached from the luminaire.

The lighting tube is put in operation by connecting it to an electricity supply, whereby the driver 7 supplies power to the light sources 6 via the circuit board 5. The light sources 6 emit light that is transmitted through the housing 2.

The person skilled in the art realizes that the present invention by no means is limited to the preferred embodiments described above. On the contrary, many modifications and variations are possible within the scope of the appended claims.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. An elongated lighting device having a first and a second suspension point for suspending the lighting device, comprising:

a housing extending from the first suspension point to the second suspension point; and a light source carrier having one or more solid state light sources mounted on a surface thereof, the carrier being arranged along the housing so that the one or more light sources emit light into the housing, wherein a wire is arranged inside the housing between the first and second suspension points so as to prevent the lighting device from bending, and wherein the wire is pre-tensioned, and wherein the wire is separate from the housing.

2. The elongated lighting device according to claim 1, wherein the housing is made from plastic.

3. The elongated lighting device according to claim 1, wherein the housing has a longitudinal slit extending along an entire length of the housing, and wherein the carrier is arranged in the slit.

4. The elongated lighting device according to claim 1, wherein the carrier has a first end portion and a second end portion, and wherein the wire is attached to the first and second end portions and separated from the carrier by two distance elements arranged between the first and second end portions.

5. The elongated lighting device according to claim 1, wherein the wire is attached to a first end piece and to a second end piece, and wherein the first end piece and the second end piece are attached to the housing and support the wire at a distance from the carrier.

6. The elongated lighting device according to claim 5, wherein the first and second end pieces are end caps sealing ends of the housing.

7. The elongated lighting device according to claim 6, wherein the wire holds the end caps against the ends of the housing.

8. The elongated lighting device according to claim 1, wherein the wire includes a first leg arranged inside said housing, and a second leg arranged outside said housing, said first and second legs forming a closed loop around the carrier.

9. The elongated lighting device according to claim 1, wherein the housing is straight.

* * * * *